US008028787B2

(12) United States Patent
Akahane et al.

(10) Patent No.: US 8,028,787 B2
(45) Date of Patent: Oct. 4, 2011

(54) WORK MACHINE

(75) Inventors: Eiji Akahane, Tokyo (JP); Christopher Michael Burton, Tokyo (JP); Nobumi Toyoura, Tokyo (JP); Shigeru Kojima, Tokyo (JP); Masayuki Takano, Hyogo (JP)

(73) Assignee: Caterpillar S.A.R.L., Geneva (CH)

( * ) Notice: Subject to any disclaimer, the term of this patent is extended or adjusted under 35 U.S.C. 154(b) by 785 days.

(21) Appl. No.: 12/096,829

(22) PCT Filed: Aug. 29, 2006

(86) PCT No.: PCT/JP2006/316910

§ 371 (c)(1),
(2), (4) Date: Jun. 10, 2008

(87) PCT Pub. No.: WO2007/069375

PCT Pub. Date: Jun. 21, 2007

(65) Prior Publication Data

US 2009/0048743 A1 Feb. 19, 2009

(30) Foreign Application Priority Data

Dec. 12, 2005 (JP) ..... 2005-358218

(51) Int. Cl.
*B60K 26/00* (2006.01)

(52) U.S. Cl. ..... 180/333; 74/471 R; 74/514

(58) Field of Classification Search ..... 701/50; 180/315, 321, 323, 324, 333; 74/471 R, 74/481, 512, 514
See application file for complete search history.

(56) References Cited

U.S. PATENT DOCUMENTS

| | | | | |
|---|---|---|---|---|
| 5,529,134 | A * | 6/1996 | Yomogita | 180/6.2 |
| 6,435,289 | B1 * | 8/2002 | Hori et al. | 180/6.3 |
| 6,643,577 | B1 * | 11/2003 | Padgett et al. | 701/50 |
| 7,379,806 | B2 * | 5/2008 | Lee | 701/50 |
| 7,621,336 | B2 * | 11/2009 | Badalamenti et al. | 166/332.8 |
| 7,828,107 | B2 * | 11/2010 | Yoshikawa et al. | 180/323 |
| 7,854,291 | B2 * | 12/2010 | Akahane et al. | 180/333 |
| 2005/0209759 | A1 | 9/2005 | Lee | |

FOREIGN PATENT DOCUMENTS

JP 06-136778 A 5/1994

(Continued)

*Primary Examiner* — Thomas Will
*Assistant Examiner* — Mai Nguyen
(74) *Attorney, Agent, or Firm* — McDermott Will & Emery LLP

(57) ABSTRACT

To provide a work machine in which traveling devices and an implement device can be operated by common operating levers, wherein switching operation is easy and a changeover is easily confirmed. Inside a cab of the work machine, there are provided travel pedals, with which the traveling devices can be operated, and operating levers, with which the traveling devices and the implement device can be operated. A changeover switch is provided on a console positioned in the vicinity of one side of an operating sheet. The changeover switch switches over between a traveling mode, in which traveling operation is possible by the operating levers, and a work mode, in which implement operation is possible by the operating levers. The work machine has a controller which makes it possible to work by the operating levers when the travel pedal is not stepped on in the case where the work mode or traveling mode is selected by the changeover switch, and makes it possible to travel by the operating levers only when the travel pedal is stepped on in the case where the traveling mode is selected by the changeover switch.

3 Claims, 4 Drawing Sheets

FOREIGN PATENT DOCUMENTS

| | | | |
|---|---|---|---|
| JP | 07-032901 | A | 2/1995 |
| JP | 07-119710 | A | 5/1995 |
| JP | 09-165788 | A | 6/1997 |
| JP | 11324026 | A | 11/1999 |
| JP | 2000-27238 | A | 1/2000 |
| JP | 2002-323931 | A | 11/2002 |
| JP | 2003-301805 | A | 10/2003 |
| JP | 2004-100397 | A | 4/2004 |
| JP | 2005-273443 | A | 10/2005 |

* cited by examiner

WORK MACHINE

CROSS REFERENCE TO RELATED APPLICATIONS

This is a U.S. national phase application under 35 U.S.C. §371 of International Patent Application No. PCT/JP2006/316910, filed Aug. 29, 2006 and claims the benefit of Japanese Application No. 2005-358218, filed Dec. 12, 2005, the contents of which are incorporated herein in their entirety. The International Application was published in Japanese on Jun. 21, 2007 as International Publication No. WO 2007/069375 under PCT Article 21(2).

TECHNICAL FIELD

The present invention relates to a work machine consisting of traveling devices and an implement device.

BACKGROUND OF THE INVENTION

As shown in FIG. 4, in a hydraulic excavator 1 as a work machine, an upper swing body 3 rotated by a swing motor 3*m* is provided on a lower traveling body consisting of left and right traveling devices 2 driven by left and right traveling motors 2*m* respectively, and a cab 4 and an implement device 5 are mounted with respect to the upper swing body 3. In the implement device 5, a base end of a boom 6 vertically rotated by a boom cylinder 6*c* is pivotally supported on the upper swing body 3, a stick 7 rotated by a stick cylinder 7*c* is pivotally supported on a top end of the boom 6, and a bucket 8 rotated by a bucket cylinder 8*c* is pivotally supported on a top end of the stick 7.

In such a hydraulic excavator, in the cab 4, travel pedals and travel levers, with which the left and right traveling devices 2 of the lower traveling body are operated, are normally provided on a front floor of an operating seat.

In the case of performing rough traveling operation, travel pedal operation by foot may be performed. However, the pedal operation is unsuitable for fine operation. Accordingly, in the case of performing the fine operation by the travel lever, it is necessary to release either of the hands from the operating levers for implement functions and swing, which are used for swing operation of the upper swing body 3 and the implement device 5 and provided left and right of the operating seat, and to extend a hand to operate the front travel lever.

Additionally, in the case of separately operating the left and right travel levers, both hands are required to be extended forward.

In the case of thus providing the travel levers in the front of the operating seat, the travel levers become an obstruction when an operator attempts to get in and out of the cab 4. Alternatively, the operator must shift the operating lever from one hand to the other for operating the travel lever and change his posture.

For example, Japanese Laid-Open Patent Publication No. 6-136778 (Page 4, FIG. 9); Japanese Laid-Open Patent Publication No. 7-32901 (Page 3, FIG. 2); Japanese Laid-Open Patent Publication No. 2002-323931 (Page 4, FIG. 1); Japanese Laid-Open Patent Publication No. 2004-100397 (Pages 7 and 15-17, FIGS. 1 and 11) disclose, as means for solving the problem, a travel operating lever in the vicinity of the operating levers for implement function and swing provided next to the operating seat.

In this case, although getting in and out for the operator is improved, the operator must, as before, shift the operating lever from one hand to the other for traveling operation, and thus a new space for the travel operating lever is required next to the operating seat.

On the other hand, for example, Japanese Laid-Open Patent Publication No. 7-119710 (Pages 2 and 3, FIG. 1) and Japanese Laid-Open Patent Publication No. 2000-27238 (Pages 4-7, FIG. 1) propose a constitution that one of the operating levers for implement function and swing can be used as the travel operating lever by means of a switching device.

Further, Japanese Laid-Open Patent Publication No. 2004-100397 (Pages 7 and 15-17, FIGS. 1 and 11) and Japanese Laid-Open Patent Publication No. 9-165788 (Pages 3 and 4, FIGS. 3 and 4) propose a constitution that left and right implement function and swing levers can be independently used for operation of left and right travel devices.

In these cases, the case of providing the switching device in addition to the operating levers provides no great difference from the case of shifting the operating lever from one hand to the other. Additionally, in the case where the switching device is attached to the operating lever, it is difficult for the operator to understand whether the operation has changed, and, at that point in time, it becomes necessary to think about which device is being operated by the operating lever.

SUMMARY OF THE INVENTION

In the case where travel levers are thus provided on a front floor of an operating seat, it is difficult for an operator to get in and out, and necessary to shift a lever from one hand to the other for operation of the travel lever and to change the operator's posture.

Additionally, in the case where traveling operation is performed by operation levers for implement function and swing by switch-operating a simple switching device provided on the operating lever or the like, it is difficult for the operator to understand whether the function has changed.

Thus, when the operator operates the operating lever with the intention of making a work machine travel, an implement function acts regardless of the operator's intention. Alternatively, when the operator operates the operating lever with the intention of operating the implement function, the work machine travels regardless of the operator's intention.

In view of these problems, the present invention has been made, and aims at providing a work machine in which switching operation is easy and a changeover is easily grasped in the case where traveling devices and the implement function can be operated by means of common operating levers.

The invention includes a work machine consisting traveling devices and an implement function includes: travel pedals with which the traveling devices can be operated; operating levers which are provided separately from the travel pedals, and with which the traveling devices and the implementation function can be operated; a changeover switch for making a changeover between a traveling mode, in which traveling operation is possible by the operating levers, and a work mode, in which implement operation is possible by the operating levers; and a controller for making it possible to work by the operating levers when the travel pedal is not operated in the case where the work mode or traveling mode is selected by the changeover switch, and making it possible to travel by the operating levers only when the travel pedal is operated in the case where the traveling mode is selected by the changeover switch.

The invention further includes a travel alarm which operates by stepping on the travel pedal in the case where the traveling mode is selected by the changeover switch.

The invention further includes a warning alarm which operates by releasing the travel pedal during the traveling operation by the operating levers, and the controller makes the warning alarm operate and stops the traveling devices and the implement device when the work mode is selected by the changeover switch during the traveling operation by the operating levers or when the traveling mode is selected by the changeover switch during the implement operation by the operating levers, and releases the warning alarm by stopping operation of the travel pedals and the operating levers for a predetermined time.

DETAILED DESCRIPTION OF THE INVENTION

According to the invention since the controller makes it possible to work by the operating levers when a travel pedal is not operated in the case where a work mode or traveling mode is selected by a changeover switch, and makes it possible to travel by the operating levers only when the travel pedal is operated in the case where the traveling mode is selected by the changeover switch, the implement operation is possible by the operating levers as conventionally in the case where the work mode is selected by the changeover switch, and normal implement operation is possible by the operating levers unless the travel pedal is stepped on even in the case where the traveling mode is selected by the changeover switch. Additionally, since the traveling operation is possible by the operating levers by stepping on the travel pedal in the case where the traveling mode is selected by the changeover switch, switching operation between the work operation and the traveling operation can be easily performed by the travel pedal without releasing a hand from the operating lever, and it is easy to grasp a changeover.

According to another aspect of the invention, since the travel pedal is operated and the traveling operation is performed by the operating lever in a state where a travel alarm goes off, an operator can clearly and consciously perform the traveling operation by the operating levers. Further, since the travel alarm goes off before the traveling operation is performed by the operating levers, an alert is issued to the surroundings well in advance.

According to a further aspect of the invention, since a warning alarm is operated when the travel pedal is released during the traveling operation by the operating levers, the operator can be warned to step on the travel pedal. Additionally, since the warning alarm is operated and the traveling devices and the implement device are stopped when the work mode is selected by the changeover switch during the traveling operation by the operating levers or when the traveling mode is selected by the changeover switch during the implement operation by the operating levers, the changeover switch can be securely prevented from being erroneously operated.

DETAILED DESCRIPTION OF THE INVENTION

Figure 3:
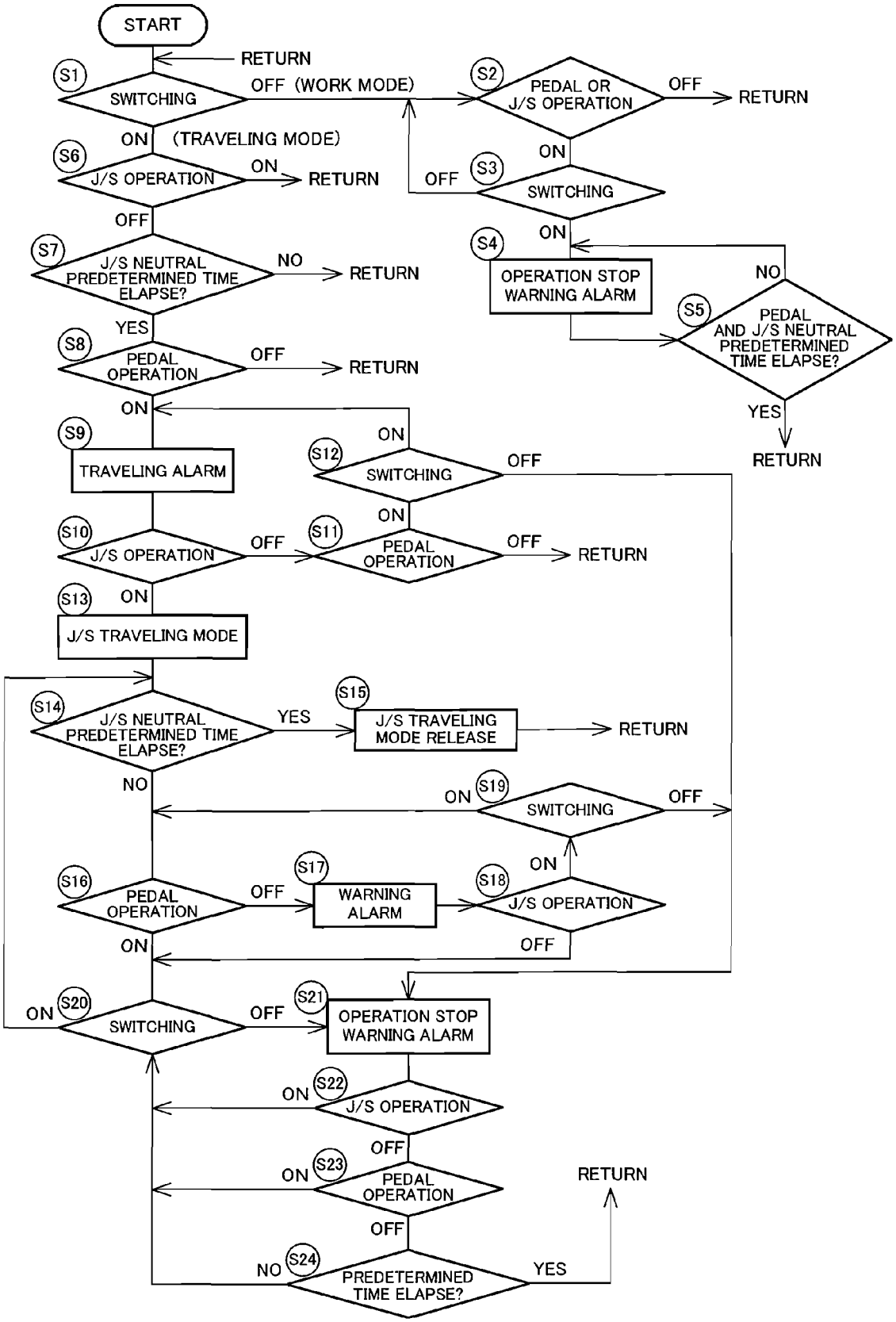
FIG. 3 is a flowchart indicating an example of a control process of the travel controlling system.
Figure 4:
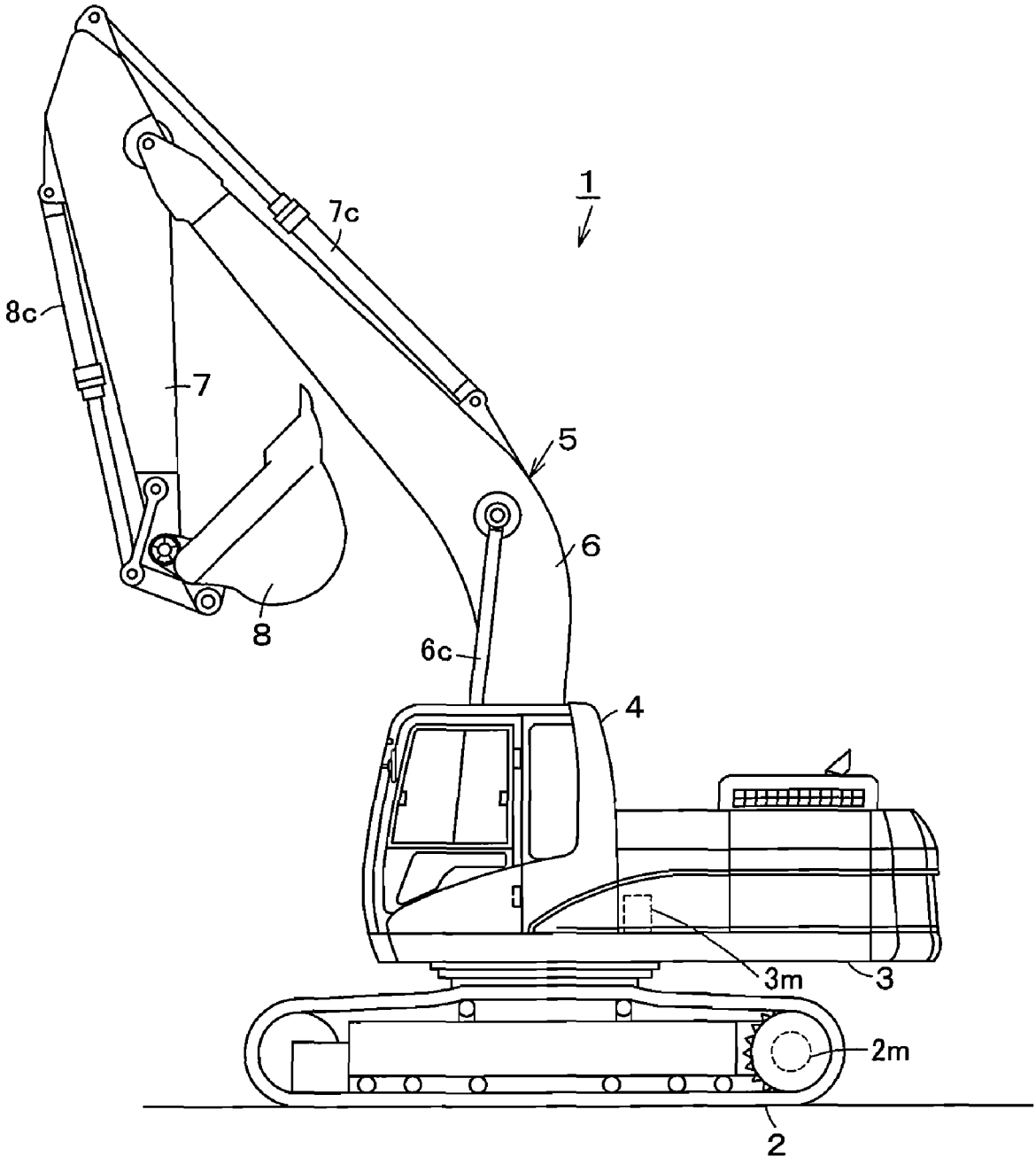
FIG. 4 is a side view of the work machine.

The present invention will be described in detail below with reference to FIGS. 1 to 3 indicating an embodiment and FIG. 4 showing a work machine. Moreover, since the work machine has already been described, a detailed description thereof will be omitted.

Figure 1:
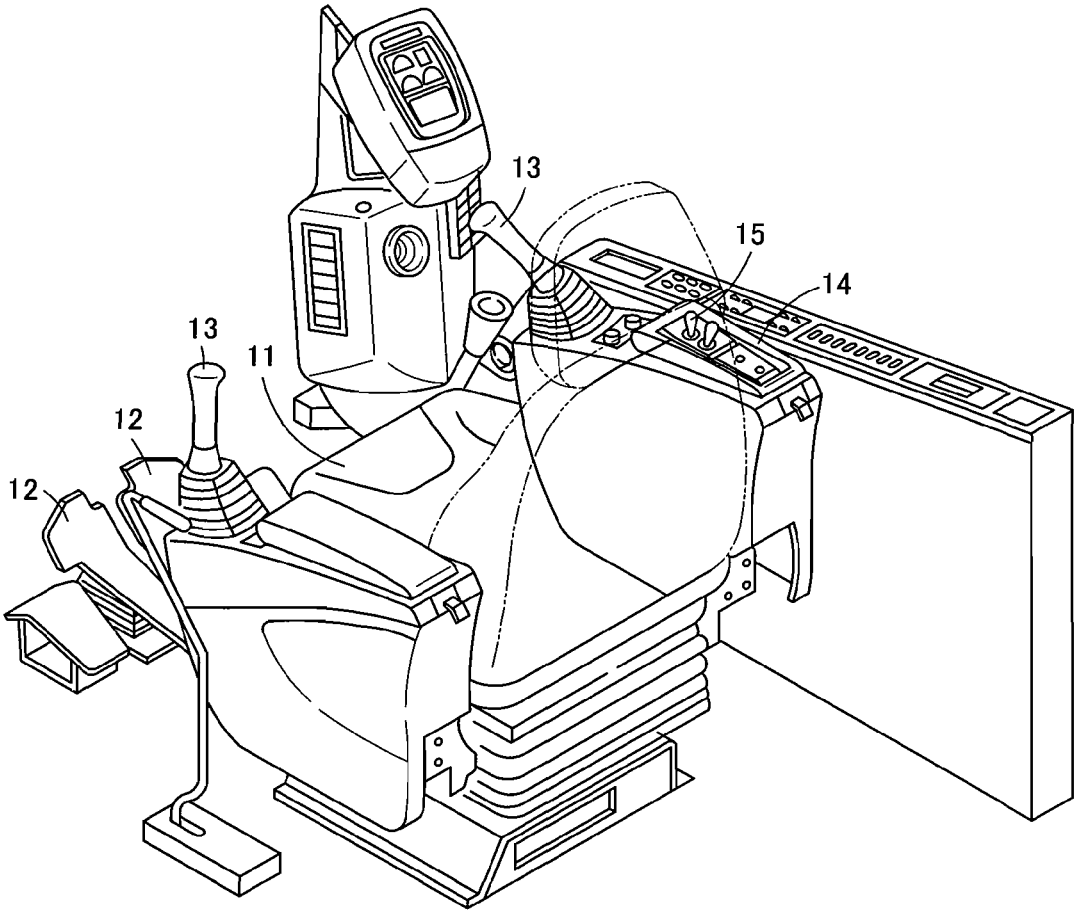
FIG. 1 is a perspective view of the interior configuration of a cab of a work machine according to an embodiment of the present invention.

In a hydraulic excavator 1, shown in FIG. 4, as a work machine including traveling devices 2 and an implement device 5, as shown in FIG. 1, inside a cab 4, a pair of travel pedals 12, with which the left and right traveling devices 2 can be operated, is arranged on a front floor of an operating seat 11 of an operator, and a pair of operating levers 13 (joystick levers indicated as J/S in a flowchart), with which traveling operation of the traveling devices 2 is possible and implement operation of the implement device 5, implement function and swing operation, is possible, is provided on both sides of the operating seat 11. Conventional travel levers provided integrally by the travel pedals 12 are removed.

Further, a changeover switch 15 is provided in the vicinity of one side of the operating seat 11, for example, on a right console 14 as shown in FIG. 1.

By use of the changeover switch 15, a changeover is made between "traveling mode" in which the traveling operation is possible by the operating levers 13, and "work mode" in which the implement operation is possible by the operating levers 13.

Figure 2:
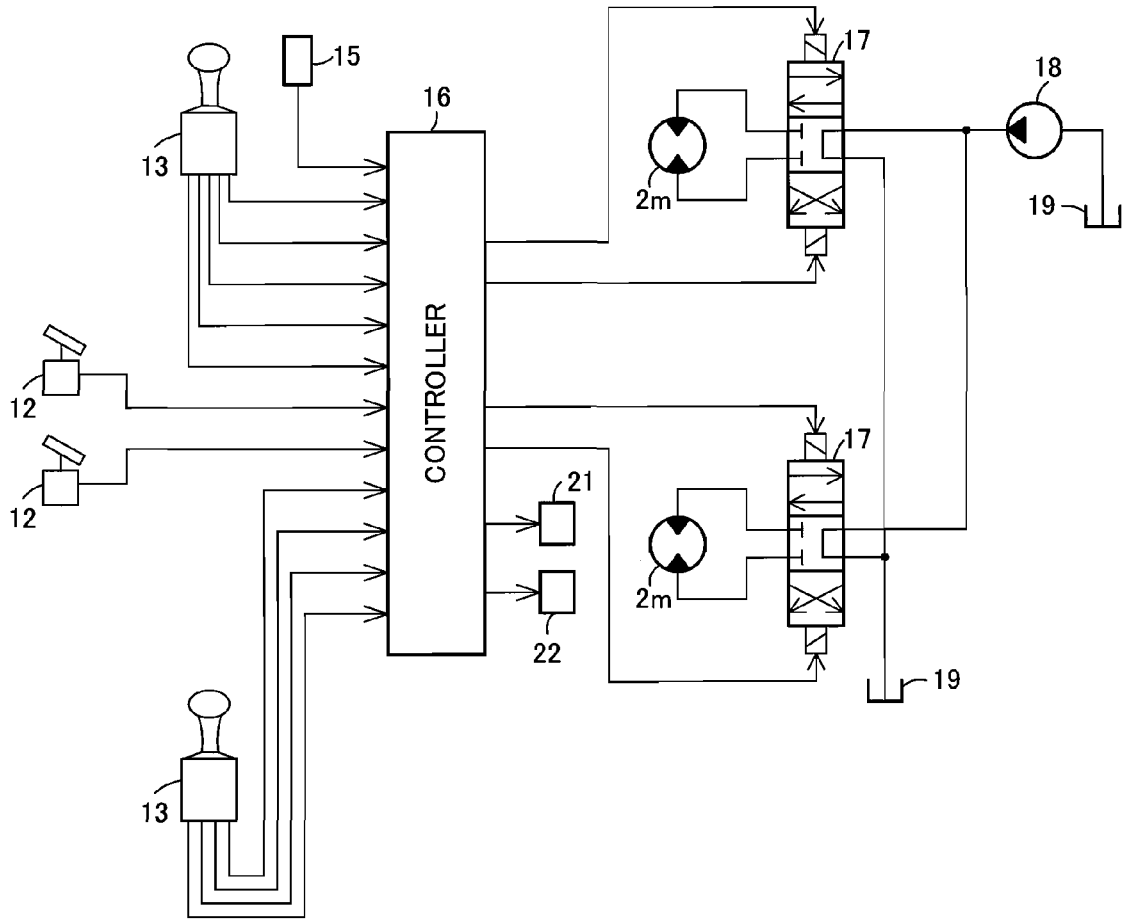
FIG. 2 is a block diagram illustrating a travel controlling system of the work machine.

As shown in FIG. 2, the travel pedals 12, the operating levers 13 and the changeover switch 15 are connected to an input side of a controller 16, an electro-magnetic operating part of travel controlling valves 17 for controlling left and right travel motors 2*m* is connected to an output side of the controller 16, a hydraulic pump 18 for feeding operation oil through a tube is connected to an oil feed port of each travel controlling valve 17, and a tank 19 for collecting return oil is connected to an oil discharge port of each travel controlling valve 17.

A travel alarm 21 and a warning alarm 22 are connected to the output side of the controller 16, the alarm 21 being operated by stepping on the travel pedal 12 in the case where the traveling mode is selected by the changeover switch 15, and the alarm 22 being operated by releasing the travel pedal 12 during the traveling operation by the operating levers 13.

The controller 16 makes it possible to work by the operating levers 13 when the travel pedals 12 are not operated, not stepped on, in the case where the "work mode" or "traveling mode" is selected by the changeover switch 15, and makes it possible to travel by the operating levers 13 only when the travel pedal 12 is operated, stepped on, in the case where the "traveling mode" is selected by the changeover switch 15.

That is, the controller 16, in the case where the operating levers 13 originally used for implement function and swing are used for traveling operation, first makes it possible to travel by the operating levers 13 in a state where the "traveling mode" is selected by the changeover switch 15 and then one of the travel pedals 12 is stepped on.

In the case where the "work mode" is selected by the changeover switch 15, normal implement function and swing action are possible by the operating levers 13, and normal operation is possible by the travel pedals 12.

In the case where the "traveling mode" is selected by the changeover switch 15, the traveling operation by the travel pedals 12 is made impossible, and the travel pedals 12 are made to serve as a permission switch of the traveling operation by the operating levers 13.

The traveling operation by the operating levers 13 is impossible until the travel pedal 12 is stepped on in the case where the "traveling mode" is selected by the changeover switch 15. Each front and back operation of the left and right operating levers 13 is adapted to correspond to each front and back action of the left and right traveling devices.

In the case where the "traveling mode" is selected by the changeover switch 15, the travel alarm 21 operates by stepping on the travel pedal 12 serving as the permission switch.

The controller 16 makes the warning alarm 22 operate and stops the traveling devices 2 and the implement device 5 when the "work mode" is selected by the changeover switch 15 during the traveling operation by the operating levers 13 or when the "traveling mode" is selected by the changeover switch 15 during work operation by the operating levers 13, and releases the warning alarm 22 by stopping operation of the traveling devices 12 and the operating levers 13 for a predetermined time.

Next, an example of a travel controlling system of the controller 16 will be described with reference to the flowchart in FIG. 3. Moreover, encircled numerals in FIG. 3 indicate step numbers respectively.

(Step S1)

It is determined whether the changeover switch 15 is switched.

(Step S2)

In the case where the changeover switch 15 is off in Step S1, it is determined whether the travel pedal 12 or operating lever 13 is operated. In the case where it is not operated, return to Step S1 is made.

(Step S3)

In the case where the travel pedal 12 or operating lever 13 is operated in Step S2, it is determined whether the changeover switch 15 is on. In the case where it is off, return to Step S2 is made.

(Step S4)

In the case where the changeover switch 15 is on in Step S3, the machine is stopped and the warning alarm 22 is operated.

(Step S5)

It is determined whether a predetermined time has elapsed in a state where the travel pedals 12 and the operating levers 13 locate at a neutral position. Before elapse of the predetermined time, return to Step S4 is made and the warning alarm 22 continues to operate. After elapse of the predetermined time, return to Step S1 is made.

(Step S6)

In the case where the changeover switch 15 is on in Step S1, it is determined whether the operating lever 13 is operated. In the case where it is operated, return to Step S1 is made.

(Step S7)

In the case where the operating lever 13 is not operated in Step S6, it is determined whether the predetermined time has elapsed in a state where the operating levers 13 locate at the neutral position of non-operation. Before elapse of the predetermined time, return to Step S1 is made.

(Step S8)

In the case where the predetermined time has elapsed in a state where the operating levers 13 locate at the neutral position in Step S7, it is determined whether the travel pedal 12 is operated. In the case where it is not operated, return to Step S1 is made.

(Step S9)

In the case where the travel pedal 12 is operated in Step S8, the travel alarm 21 operates. The travel alarm 21 does not warn the operator that operation is prohibited, but informs the operator that the travel pedal 12 is operated.

(Step S10)

It is determined whether the operating lever 13 is operated.

(Step S11)

In the case where the operating lever 13 is not operated in Step S10, it is determined whether the travel pedal 12 is operated. In the case where it is not operated, return to Step S1 is made.

(Step S12)

In the case where the travel pedal 12 is operated in Step S11, it is determined whether the changeover switch 15 is on. In the case where it is on, return to Step S9 is made.

(Step S13)

In the case where the operating lever 13 is operated in Step S10, the travel mode by the operating lever is set by the operating lever 13.

(Step S14)

It is determined whether the predetermined time has elapsed in a state where the operating levers 13 locate at the neutral position.

(Step S15)

In the case where the predetermined time elapsed in a state where the operating levers 13 locate at the neutral position in Step S14, the travel mode by the operating lever is released and return to Step S1 is made.

(Step S16)

Before the operating levers 13 locate at the neutral position for the predetermined time in Step S14, it is determined whether the travel pedal 12 is operated.

(Step S17)

In the case where the travel pedal 12 is not stepped on in Step S16, the warning alarm 22 operates.

(Step S18)

It is determined whether the operating lever 13 is operated. In the case where it is not operated, advance to Step S20 is made.

(Step S19)

In the case where the operating lever 13 is operated in Step S18, it is determined whether the changeover switch 15 is on. In the case where it is on, return to Step S16 is made. In the case where it is off, advancing to Step S21 is made.

(Step S20)

In the case where the travel pedal 12 is operated in Step S16, it is determined whether the changeover switch 15 is on. In the case where it is on, return to Step S14 is made.

(Step S21)

In the case where the changeover switch 15 is off in Steps S12, S19 and S20, the machine is stopped, and the warning alarm 22 operates.

(Step S22)

It is determined whether the operating lever 13 is operated. In the case where it is operated, return to Step S20 is made.

(Step S23)

In the case where the operating lever 13 is not operated in Step S22, it is determined whether the travel pedal 12 is operated. In the case where it is operated, return to Step S20 is made.

(Step S24)

In the case where the travel pedal 12 is not operated in Step S23, it is determined whether the predetermined time has elapsed. Before elapse of the predetermined time, return to Step S20 is made. After elapse of the predetermined time, return to Step S1 is made.

The summary of the above flowchart is as follows.

In the case where the changeover switch 15 is on, the traveling operation is possible by the operating levers 13 only while the travel pedal 12 is stepped on.

In the case where the changeover switch 15 is off, normal implement operation is possible by the operating levers 13.

When the travel pedal 12 is released during traveling operation by the operating levers 13, the warning alarm 22 continues to go off until operation of the operating levers 13 is stopped.

When the changeover switch 15 is turned off during traveling operation by the operating levers 13, the warning alarm 22 goes off and the machine is stopped. In this case, for the predetermined time, return to an initial state is made if the entire operation is made neutral.

While traveling by the travel pedal 12, when the changeover switch 15 is turned on during the implement function operation by the operating levers 13, the warning alarm 22 goes off and the machine is stopped.

In this case, the warning alarm 22 continues to go off until operation of the travel pedals 12 and operating levers 13 are stopped. When the warning alarm 22 stops going off, return to the initial state is made.

Next, effects of the embodiment will be described.

In the case where the work mode is selected by the changeover switch 15, the implement operation, that is, implement function and swing operation, is possible as conventionally. Unless the travel pedal is stepped on even in the case where the traveling mode is selected by the changeover switch 15, the normal implement function and swing operation are possible by the operating levers 13.

Further, in the case where the traveling mode is selected by the changeover switch 15, the traveling operation is possible by the operating lever 13 by stepping on the travel pedal 12, and therefore the changeover is possible by the travel pedal 12 without releasing a hand from the operating lever 13.

Additionally, the operator can be informed of the changeover by stepping on the travel pedal 12 which serves, due to the changeover switch 15, as the "permission switch" of the traveling operation by the operating lever 13.

That is, since the travel pedal 12 is stepped on and the traveling operation is performed by the operating lever 13 in a state where the travel alarm 21 goes off, the operator can operate while being aware of the changeover.

Additionally, since the travel alarm 21 goes off before the traveling operation by the operating lever 13, an alert is issued to the surroundings well in advance. Since, according to this method, only the changeover switch 15 is added to the console 14 or cab 4, the space in the cab 4 receives little influence and this method is applicable to machines on the market.

The controller 16 makes it possible to work by the operating levers 13 when the travel pedal 12 is not stepped on in the case where the work mode or traveling mode is selected by the changeover switch 15, and makes it possible to travel by the operating levers 13 only when the travel pedal 12 is stepped on in the case where the traveling mode is selected by the changeover switch 15. Accordingly, the implement operation is possible by the operating levers 13 as conventionally in the case where the work mode is selected by the changeover switch 15. Further, unless the travel pedal 12 is stepped on even in the case where the traveling mode is selected by the changeover switch 15, the normal work operation is possible by the operating levers 13. Furthermore, since the traveling operation is possible by the operating levers 13 by stepping on the travel pedal 12 in the case where the traveling mode is selected by the changeover switch 15, the changeover can be easily performed between the work operation and the traveling operation by stepping on the travel pedals 12 without releasing a hand from the operating lever 13 and is easily grasped.

Since the traveling operation is performed by the operating levers 13 in a state where the travel pedal 12 is stepped on and the travel alarm 21 goes off, the operator can perform the traveling operation by the operating levers 13 while being clearly aware of the operation. Further, since the travel alarm 21 goes off before the traveling operation by the operating levers 13, an alert is issued to the surroundings well in advance.

Since the warning alarm 22 is operated when the travel pedal 12 is released during the traveling operation by the operating levers 13, the operator can be warned to step on the travel pedal 12. Additionally, since the warning alarm 22 is operated and the traveling devices 2 and the implement device are stopped when the work mode is selected by the changeover switch 15 during the traveling operation by the operating lever 13 or when the traveling mode is selected by the changeover switch 15 during the work operation by the operating lever 13, the changeover switch 15 can be securely prevented from being erroneously operated.

The present invention is applicable to a swing type work machine as a hydraulic excavator 1, and further applicable to a non-swing type work machine including traveling devices 2 and an implement device 5.

The invention claimed is:

1. A work machine having traveling devices and an implement device, the machine comprising:

travel pedals with which the traveling devices can be operated;

operating levers which are provided separately from the travel pedals, and with which the traveling devices can be operated and the implement device can be operated;

a changeover switch for making a changeover between a traveling mode, in which traveling operation is possible by the operating levers, and a work mode, in which implement operation is possible by the operating levers; and a controller for making it possible to work by the operating levers when the travel pedal is not operated in the case where the work mode or traveling mode is selected by the changeover switch, and making it possible to travel by the operating levers only when the travel pedal is operated in the case where the traveling mode is selected by the changeover switch.

2. The work machine according to claim 1 comprising a travel alarm which operates by stepping on the travel pedal in the case where the traveling mode is selected by the changeover switch.

3. The work machine according to claim 1, comprising a warning alarm which operates by releasing the travel pedal during the traveling operation by the operating levers, wherein the controller makes the warning alarm operate and stops the traveling devices and the implement device when the work mode is selected by the changeover switch during the traveling operation by the operating levers or when traveling mode is selected by the changeover switch during the implement operation by the operating levers, and releases the warning alarm by stopping operation of the travel pedals and the operating levers for a predetermined time.

* * * * *